US005529248A

United States Patent [19]

Sawamura et al.

[11] Patent Number: 5,529,248

[45] Date of Patent: Jun. 25, 1996

[54] METHOD AND APPARATUS FOR GRINDING MATERIAL PARTICLES

[75] Inventors: Seisuke Sawamura, Akashi; Hiroshi Ueda, Kobe; Kanzaburo Sutou, Kamikawa-machi; Mitsuaki Murata, Chichibu, all of Japan

[73] Assignees: Kawasaki Jukogyo Kabushiki Kaisha, Hyogo-ken; Chichibu Cement Co., Ltd., Tokyo-To, both of Japan

[21] Appl. No.: 262,548

[22] Filed: Jun. 20, 1994

[30] Foreign Application Priority Data

Oct. 15, 1993 [JP] Japan ..... 5-281615

[51] Int. Cl.[6] ..... B02C 21/00; B02C 23/12

[52] U.S. Cl. ..... 241/19; 241/29; 241/33; 241/78; 241/79.1; 241/80; 241/152.2

[58] Field of Search ..... 241/19, 24, 29, 241/33, 76, 77, 78, 79, 79.1, 80, 81, 97, 152.2; 209/136, 137, 138, 139.1

[56] References Cited

U.S. PATENT DOCUMENTS

| | | | |
|---|---|---|---|
| 3,329,352 | 7/1967 | Clary et al. | 241/79.1 X |
| 3,540,662 | 11/1970 | Abel | 241/19 |
| 3,963,181 | 6/1976 | Deloy et al. | 241/79.1 X |
| 4,293,098 | 10/1981 | Muralidhara | 241/19 |
| 4,304,360 | 12/1981 | Luhr et al. | 241/79.1 X |
| 4,946,044 | 8/1990 | Havrilla . | |
| 5,005,770 | 4/1991 | Suessegger | 241/152.2 X |
| 5,221,051 | 6/1993 | Hashimoto et al. | 241/152.2 X |
| 5,392,998 | 2/1995 | Suessegger et al. | 241/79.1 |

FOREIGN PATENT DOCUMENTS

| | | | |
|---|---|---|---|
| 956555 | 2/1950 | France . | |
| 63-116751 | 5/1988 | Japan . | |
| 226822 | 6/1991 | Japan | 241/79.1 |
| 4-338244 | 11/1992 | Japan . | |
| 285410 | 11/1993 | Japan | 241/79.1 |
| 2078552 | 1/1982 | United Kingdom . | |

OTHER PUBLICATIONS

Patent Abstracts of Japan, vol. 015, No. 043 (C–0801), 31 Jan. 1991 & JP–A–02 277561, 14 Nov. 1990.

*Primary Examiner*—Timothy V. Eley
*Attorney, Agent, or Firm*—Oliff & Berridge

[57] ABSTRACT

A grinding apparatus includes a roller mill in which material particles are pre-ground, a tube mill connected to the roller mill through a fluidized-bed-type classifying device in which the material particles are classified by size and a circulation line is connected between the classifying device and the roller mill, wherein a fluidized portion of the pre-ground particles, which consists of a fine material component is fed into a tube mill, a remaining portion of the pre-ground particles, which consists of course material and some amount of fine material not fed into the tube mill is returned to the roller mill through the circulation line where the remaining portion of the pre-ground particles is again crushed together with newly fed material particles in the roller mill. The fluidized-bed-type classifying device is provided with a first chute through which the fine material component flows out to the tube mill and a second chute connected to the circulation line through which the remaining portion is returned to the roller mill. The inner hollow space of the fluidized-bed-type classifying device is divided into an air introduction section and a fluidized bed section by a porous partition plate arranged horizontally with inclination toward the second chute. The fluidized bed section communicates with both the tube mill and the roller mill and the air introduction section communicates with the material fluidizing air which has a controllable flow rate.

13 Claims, 3 Drawing Sheets

METHOD AND APPARATUS FOR GRINDING MATERIAL PARTICLES

BACKGROUND OF THE INVENTION

The present invention relates to a method of and apparatus for grinding material particles such as cement clinker, slag or ore, and a grinding apparatus provided with a classifying device for performing classification of the material particles.

In a prior art technique, when it is required to manufacture cement powders by grinding burned cement clinkers, a tube mill has been utilized as a grinding means. The tube mill comprises a tubular (cylindrical) rotary container in which a number of steel balls are accommodated, and the material particles to be ground are subjected to the grinding operation in the container by rotating the same.

In such a grinding operation, when the materials including coarse particles, each having a relatively large diameter, are to be ground, it is necessary to utilize balls each having a large diameter. However, when the balls having large diameter are utilized, contacting areas between the balls and the material particles are reduced, thus reducing the grinding efficiency. Accordingly, in recent years, a roller mill is often used for precedingly grinding the material particles including coarse particles in combination with the tube mill.

The roller mill, for example, a vertical roller mill, has a structure in which peripheral surfaces of a plurality of rollers are pressed against an upper surface of a table rotating in a horizontal plane and the material particles supplied on the table are ground by being pressed by the rollers. As described, since the coarse materials can be effectively ground by applying sufficient pressing force to the rollers, the roller mill is effective for the coarse grinding operation for the succeeding operation for the tube mill. When the material particles are thus ground to fine particles by means of a roller mill, the grinding efficiency of the tube mill can be improved by using a smaller size of steel balls.

FIGS. 3 and 4 shows examples of conventional grinding apparatus constructed as a combination of a roller mill and a tube mill.

FIG. 3 shows an arrangement of the grinding apparatus disclosed in the Japanese Patent Laid-Open Publication (KOKAI) No. SHO 63-116751 (116751/1988), in which a vibration screening device 1 having screens 1*a* as a classifier is arranged in a material conveying path 20 extending from a vertical roller mill 10 having a roller 12 therein to a tube mill 40. A fine powder component classified by the vibration screening device 1 is fed to the tube mill 40 through the material conveying path 20. A coarse particle component classified thereby is returned to the roller mill 10 through a material circulation path 25.

FIG. 4 shows an arrangement of the grinding apparatus disclosed in the Japanese Patent Laid-Open Publication (KOKAI) No. HEI 4-338244 (338244/1992), in which a distributing device 2 is disposed in place of the vibration screening device 1 of the example of FIG. 3. The distributing device 2 is provided with a butterfly-damper-type plate member 2*b* variable in angle in a fork-shaped case 2*a*. An amount of distribution of particle material can be adjusted in directions to be supplied by adjusting the angle arrangement of the plate member 2*b*. That is, as shown in FIG. 4, one forked portion 2*a* is connected to the material conveying path 20 connected to the tube mill 40 and the other forked portion 2*a* is connected to the circulation path 25 connected to the vertical roller mill 10 having roller 12 installed therein. Thus, in this example, a portion of the particle material subjected to a pre-grinding operation is fed to the tube mill 40 and a remaining portion thereof is returned to the roller mill 10.

In both examples of FIGS. 3 and 4, the material ground by the tube mill 40 is then fed to a separator 52 through a bucket elevator conveyor 51, and the material finally ground by the tube mill 40 is separated by the separator 52 to a material component capable of being utilized as a product and another material component to be re-ground.

In the example of FIG. 3, the fine material component, in the pre-ground material, classified by the vibration screening device 1, i.e. the material passing through meshes of the screening device having predetermined mesh size, can be fed to the tube mill 40. Accordingly, it is possible to improve the grinding efficiency in maximum by utilizing balls each having a small diameter. However, this example involves a problem in relation to the fact that only the coarse material exactly classified by the vibration screening device 1 is returned to the roller mill 10. Since the material returned to the roller mill 10 does not substantially include a fine material component, a high percentage of void is provided in the material particles fed to the roller 12, which may result in violent vibration or oscillation at the line of grinding of the roller mill 10.

In order to suppress or control such vibration, it is necessary to limit a pressing force of the rollers 12 disposed in the roller mill 10. This, however, provides a significant problem such that the roller mill 10 can not achieve sufficient grinding efficiency in a pre-grinding process. In addition to the above defect, in the example of FIG. 3, an extremely large-sized and expensive vibration screening device 1 is required, and it is necessary to arrange various screens 1*a* having different mesh sizes to change the classifying levels or degrees. Moreover, since an amount of the material to be fed to the tube mill 40 is decided in accordance with the screens 1*a* utilized, which is not controlled during the operation of the apparatus, it is difficult to maintain or control the amount of the product stably.

On the other hand, the example of FIG. 4 is an apparatus provided for obviating the problems of the apparatus of FIG. 3. That is, in this apparatus, as described above, the fine particles are also fed to the roller mill 10 together with the coarse particles, thus providing a relatively low percentage of void in the feeding materials to the roller, and accordingly, a reduced vibration is caused during the re-grinding operation in the roller mill 10, whereby the grinding efficiency in the roller mill 10 can be improved, thus being advantageous in comparison with the example of FIG. 3.

On the contrary, however, the apparatus of FIG. 4 is inferior to that of FIG. 3 in a point that the coarse material is also fed to the tube mill 40 together with the fine material subjected to the pre-grinding operation. Therefore, it is necessary for the tube mill to use balls each having a large diameter, which results in the lowering of the grinding efficiency in the tube mill as mentioned hereinbefore.

Accordingly, in both the examples of the conventional grinding apparatus of FIGS. 3 and 4, it is difficult to achieve the improved grinding efficiency both in the roller mill and the tube mill.

SUMMARY OF THE INVENTION

An object of the present invention is to substantially eliminate defects or drawbacks encountered in the prior art and to provide a method of and an apparatus of grinding material particles provided with an improved material classifying device capable of improving a grinding operation and grinding efficiency.

This and other objects can be achieved according to the present invention by providing, in one aspect, a method of grinding material particles by utilizing a grinding apparatus provided with a roller mill, a tube mill and a classifying device for classifying material particles in accordance with the sizes thereof, in which the material particles are fed into the roller mill in which the material particles are pre-ground, the method being characterized in that the classifying device is a fluidized-bed-type classifying device and the pre-ground material particles are fed into the fluidized-bed-type classifying device in which the pre-ground material particles are fluidized and classified, a fluidized portion of fine material component is fed into the tube mill, a remaining portion not fed to the tube mill is returned to the roller mill, and the returned portion of the material component is again ground together with newly fed material particles in the roller mill.

The fluidizing of the pre-ground material particles is performed by forcibly introducing air into the fluidized-bed-type classifying device. An amount of the fluidized material to be fed into the tube mill and an amount of the introducing air are regulated by adjusting the air to be introduced.

In another aspect, there is provided a grinding apparatus including a roller mill into which material particles are fed and in which the material particles are pre-ground, a tube mill connected to the roller mill through a classifying device in which the material particles are classified in accordance with the sizes thereof, the grinding apparatus being characterized in that the classifying device is a fluidized-bed-type classifying device connected to the roller mill through a first material conveying line and having an inner hollow structure in which the pre-ground material particles are fluidized and classified, the tube mill is connected to the fluidized-bed-type classifying device through a second material conveying line and a circulation line is connected between the fluidized-bed-type classifying device and the roller mill, wherein a fluidized portion of fine material component is fed into a tube mill, a remaining portion not fed to the tube mill is returned to the roller mill through the circulation line and the returned portion of the material component is again ground together with newly fed material particles in the roller mill.

In a preferred embodiment, the fluidized-bed-type classifying device is provided with a first chute connected to the second material conveying line through which the fine material component flows out to the tube mill and a second chute means connected to the circulation line through which the remaining material component is returned to the roller mill.

The inner hollow space of the fluidized-bed-type classifying device is divided into a first section and a second section by a porous partition plate arranged horizontally with inclination toward the second chute, the first section being formed as a fluidized bed chamber communicating with the first material conveying line and the second section disposed below the first section and communicating with the material fluidizing means.

The second chute has a lower surface positioned substantially flush with one end portion of the inclined partition plate. The first chute is disposed above the second chute.

The material is fluidized in the fluidized bed chamber by an air introducing means connected to the lower portion of the second section through which air is forcibly introduced into the fluidized bed chamber through the first section and the porous partition plate to fluidize the material in the fluidized bed chamber. The air introducing means is provided with an air flow rate control valve for controlling a flow rate of air to be introduced into the fluidized-bed-type classifying device.

The second chute is provided with a flow control gate for adjusting an amount of the material to be discharged from the fluidized-bed-type classifying device through the second chute.

According to the present invention, the material particles are ground first by the roller mill to obtain pre-ground material particles, which are then fed to the tube mill to further grind the same. The classifying device of the fluidized-bed type is utilized in the present invention between the roller mill and the tube mill to effectively classify the material particles into fine component particle and coarse component. The fine component fluidized in the classifying device are fed to the tube mill and, on the contrary, the coarse component not fluidized and not fed to the tube mill is again returned to the roller mill. The returned coarse component is again ground together with newly fed material particles.

The utilization of the fluidized-bed-type classifying device for the grinding apparatus provided with, in combination, the roller mill and the tube mill, can achieve the following advantages. The classifying ability or performance of the fluidized-bed-type classifying device is not so high, thus being inconvenient when it is utilized for another apparatus for obtaining high classifying performance. However, such inconvenience or insufficient classifying is applicable or suitable for the grinding apparatus provided with the roller mill and the tube mill.

In detail, in the present invention, the pre-ground material in the roller mill is fed to the fluidized-bed-type classifying device in which the material particles are fluidized by forcibly introducing air. Through this fluidizing operation, the fluidized fine component is flowed out to the tube mill, and the not fluidized component and some amount of fine component are returned to the roller mill to be again subjected to the grinding operation. The fact that the returned material includes some amount of the fine component reduces the percentage of void of the material to be returned to the roller mill, which results in the reducing or suppressing of the causing of the vibration in the roller mill and, hence, the pressing force of the roller to grind the material can be increased.

As described above, according to the present invention, the material grinding efficiency can be remarkably improved not only in the tube mill but also in the roller mill, which is not achieved by the conventional grinding apparatus.

Furthermore, the fluidized-bed-type classifying apparatus of the present invention has a compact structure and is provided with a control device for easily controlling the air supply to change the fluidizing ability, and hence, the amount and the sizes of the materials to be fed to the tube mill or returned to the roller mill can be easily controlled or adjusted, being applicable to various utilization of the grinding apparatus.

In the actual processes of the fluidized-bed-type classifying device, the partition plate formed with a number of pores is disposed to divide the interior of the classifying device into upper and lower sections, and the partition plate is disposed with inclination towards the discharge chute and connected to the roller mill through the circulation line. Accordingly, the pre-ground material particles in the roller mill are fluidized therein by introducing the air from lower the side the classifying device with an amount controlled, so that the fine material component is fluidized and the material component not fluidized falls on the partition plate having an inclination, the material not fluidized is easily moved along the inclination to the discharge chute.

Accordingly, as described above, the fine material component fluidized by controlling the air introduction amount can be fed into the tube mill in which further grinding operation is performed, and the coarse material component together with some amount of fine component not fluidizing are returned to the roller mill in association with the location of the inclined porous partition plate.

Thus, according to the present invention, the grinding operation is done automatically and stably, and a stable amount of material is produced.

The further nature and features of the present invention will be made more clear through the following description with reference to the accompanying drawings.

DESCRIPTION OF THE PREFERRED EMBODIMENTS

Figure 1:
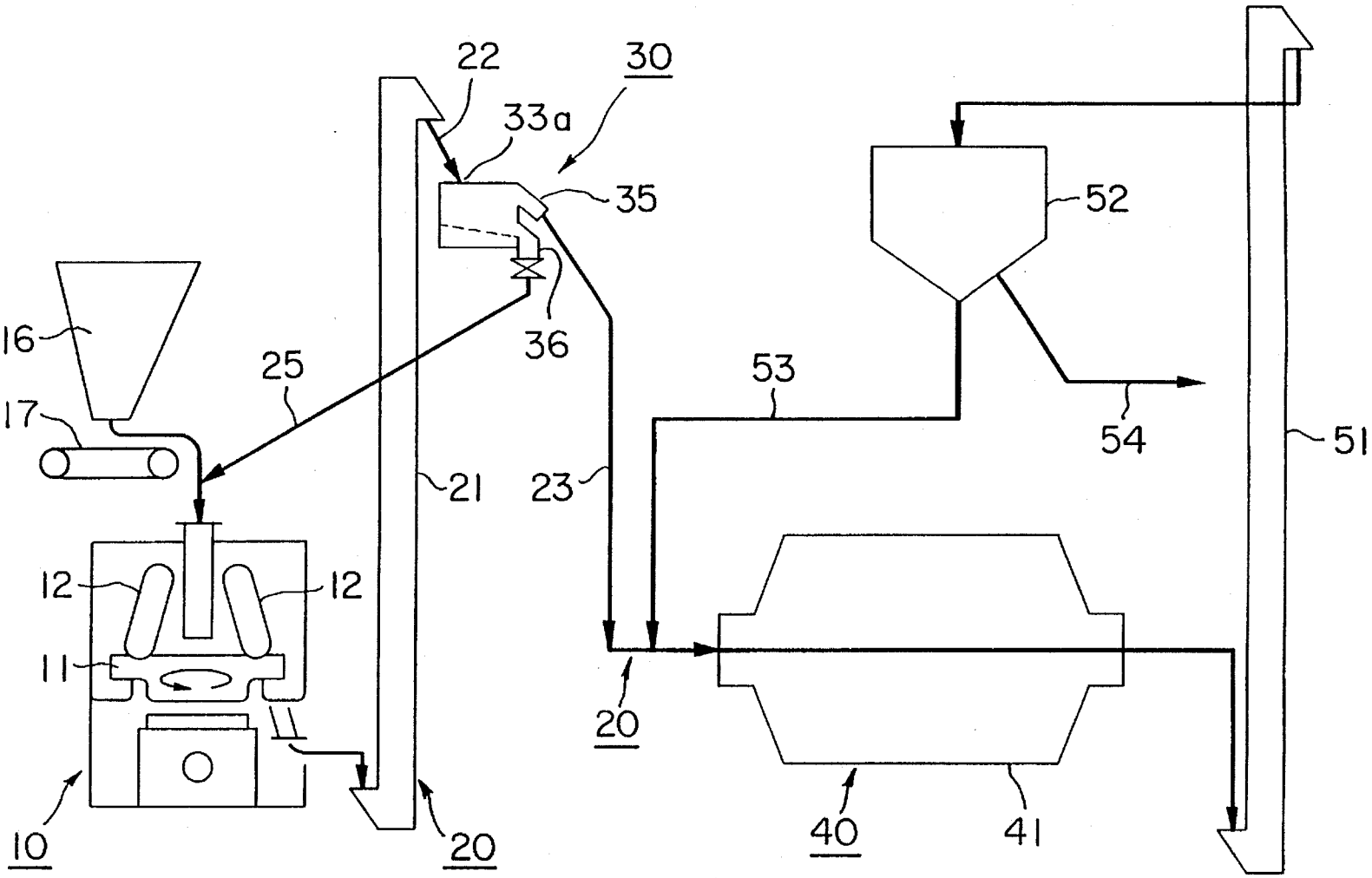
FIG. 1 is a diagram of a grinding apparatus according to the present invention which is particularly useful for carrying out a cement clinker grinding method.
Figure 2:
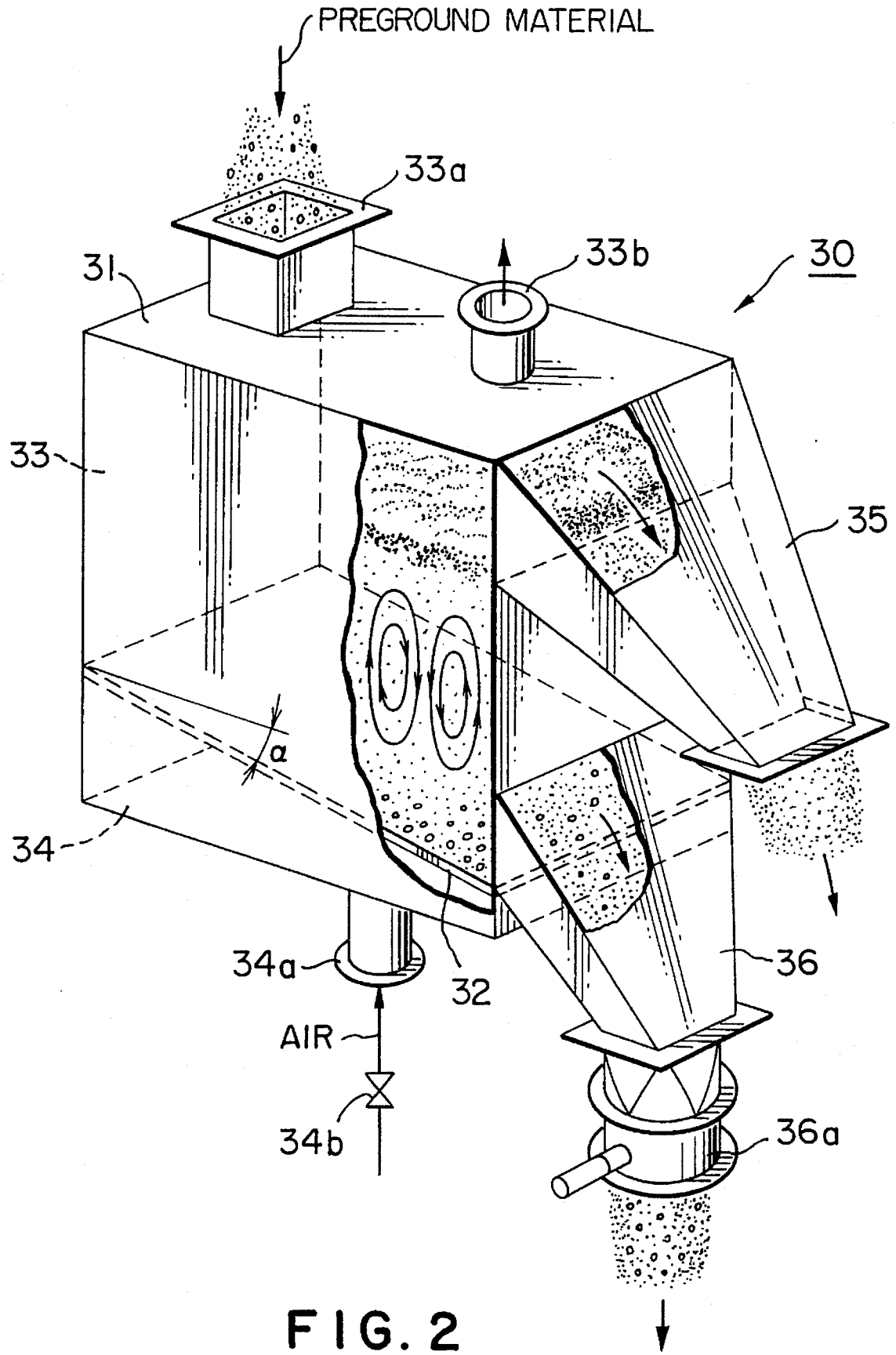
FIG. 2 is a perspective view, partially in section, of a fluidized-bed-type classifying device disposed in the grinding apparatus of FIG. 1.
Figure 3:
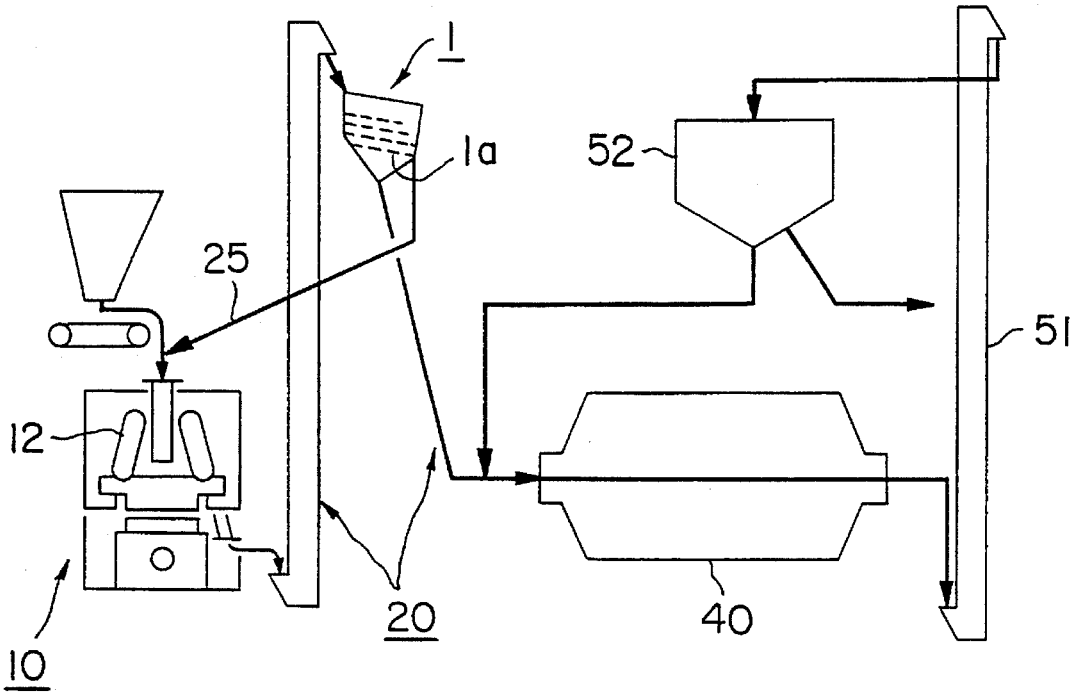
FIG. 3 PRIOR ART
FIG. 3 is a diagram showing one example of a grinding apparatus of a conventional type.
Figure 4:
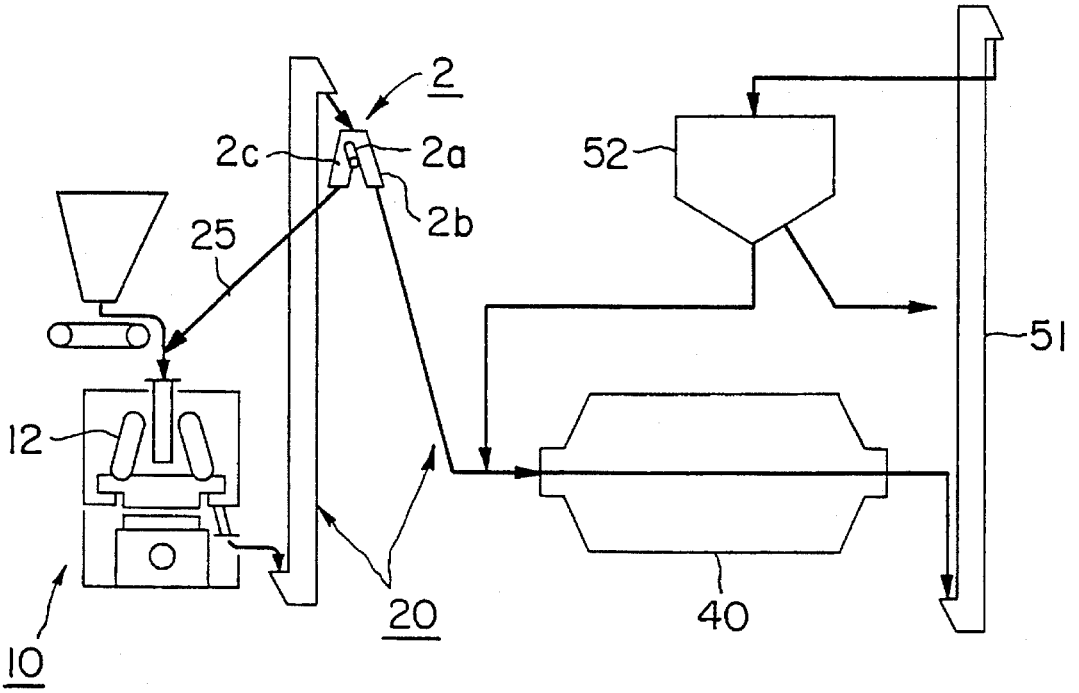
FIG. 4 PRIOR ART
FIG. 4 is a diagram showing another example of a grinding apparatus of a conventional type.

FIGS. 1 and 2 represent one embodiment according to the present invention, in which like reference numerals to represent to elements corresponding to those shown in FIGS. 3 and 4. FIG. 1 is a schematic diagram showing an arrangement of a grinding apparatus for producing a cement powder product and FIG. 2 is a perspective view of a fluidized-bed type classifying device 30 of the apparatus shown in FIG. 1.

The grinding apparatus of FIG. 1 is constructed in basic structure as a combination of a vertical roller mill 10 and a tube mill 40, which have substantially the same structures as those shown in FIG. 3 or 4.

In a grinding operation of a cement clinker by the grinding apparatus of FIG. 1, the cement clinkers as original material are pre-ground by the roller mill 10, and the pre-ground material is then secondarily ground by the tube mill 40, thus providing a cement powder product. The roller mill 10 includes a table 11 rotatably arranged and pressing rollers 12 that are pressed against the table 11. The cement clinker as the material is fed in a hopper 16 and then to the roller mill 10 through a feeder 17 for feeding a predetermined amount thereof to the roller mill 10. The material pre-ground in the roller mill 10 is then fed to the tube mill 40 through a material conveying path 20 which is provided with a bucket elevator conveyor 21 and gravitationally falling type conveyor tubes 22 and 23.

The tube mill 40 comprises a cylindrical container 41 capable of rotating in which iron balls, not shown, are disposed. The tube mill 40 is provided with a material inlet connected to the material conveyor path 20 and a material outlet connected to a cyclone separator 52 through a bucket elevator conveyor 51. The material ground in the tube mill 40 and fed into the separator 52 is separated therein into a fine material component and a coarse material component. The fine material component is fed to a conveyor tube 54 through which a product material, cement powder in the embodiment, is obtained, and the coarse material is again supplied to the tube mill 40 through a conveyor tube 53.

In the grinding apparatus of this embodiment, the material fed through the hopper 16 is pre-ground so that the ground material generally includes the material particles each having a diameter less than 1 mm in an amount of about 65% and includes material particles each having a diameter less than 400 μm in an amount of about more than 50%, but includes coarse material particles each having a diameter of 2.5 to 15 mm in an amount of about 20%. On the other hand, it is generally necessary for the final material powders obtained through the conveyor tube 54 each to have a diameter less than about 44 μm, totally, for example, as product material.

In the grinding apparatus according to the present invention, a fluidized-bed-type classifying device 30 is arranged between the conveyor tubes 22 and 23 in the material conveyor path 20. That is, the material from the roller mill 10 is fed into the classifying device 30 through the conveyor tube 22 and then fed into the tube mill 40 from the classifying device 30 through the conveyor tube 23.

With reference to FIG. 2, the fluidized-bed-type classifying device 30 comprises a casing 31 having a substantially box-shaped structure including an inner hollow portion which is divided into upper and lower sections by a porous partition plate 32 acting as a filter member. The porous partition plate 32 is inclined horizontally by an angle $\alpha$ of about 30°, preferably. The upper section is formed as a fluidized bed chamber 33 and the lower section is formed as an air introducing chamber 34 provided with an air introducing port **34*a* formed to the bottom of the air introducing chamber 34, i.e. the casing 31. To the top wall of the fluidized bed chamber 33, i.e. the casing 31, are formed a material feeding inlet 33*a* and an air discharge outlet 33*b*. According to this structure of the classifying device 30, when the pre-ground material is fed into the fluidized bed chamber 33 from the conveyor tube 22 through the material inlet 33*a* formed to the top wall of the chamber 33 and, simultaneously, the air is introduced into the chamber 33 through the air introducing port 34*a* formed to the bottom of the casing 31, the fine material particles or powders each having a diameter less than a predetermined size are floated and fluidized in the fluidized bed chamber 33 by the forcible introduction of the air introduced through the pores formed to the porous partition plate 32**.

An upper chute 35 is provided to an upper portion, apart from the porous plate 32, of the side wall of the fluidized bed chamber 33 and a lower chute 36 is also provided to a lower portion thereof. The lower level of the lower chute 36 is continuous to or flush with the upper surface of the porous plate 32 and the porous plate 32 has a downward inclination towards the lower chute 36. Accordingly, a portion of the floating and fluidizing fine material flows out through the upper chute 35, and the remaining portion of the material, that is, the coarse material not floated and fluidized and some amount of the fine material which falls on the porous plate 32, are discharged through the lower chute 36 because of the downward inclination of the porous partition plate 32.

Further, when a roller mill having a grinding ability of 150 ton/hour is utilized, a classifying device having a porous partition plate having a surface area of about 1.0 $m^2$ and a fluidized bed chamber having a height of about 1.6 m will be required, thus making extremely compact the classifying device, being advantageous in space utilization and manufacturing cost.

The fluidized-bed-type classifying device 30 according to the present invention is further provided with a control means for controlling or adjusting the sizes and amount of the materials discharged through the upper and lower chutes 35 and 36.

An air flow rate control valve **34*b* is provided for the air introducing port 34*a*, and a flow control gate 36*a*, having an opening controllable in opening degree, is provided for the lower chute 36** as a discharge rate regulating means.

When, for example, it is desired for the present invention to flow out fine materials each having a diameter less than about 1 mm through the upper chute 35, the valve **34*b* is first regulated to obtain the air flow velocity of about 1 m/sec. in the fluidized bed chamber, whereby the fine material powders each having a diameter of less than 1 mm are fluidized and flowed out as the fine material powders through the upper chute 35. The discharge amount of the coarse material powders or particles can be regulated to the amount of about 40% in total by adjusting the opening degree of the flow control gate 36*a*. According to this structure and operation, the coarse material powders, not fluidized, each having a diameter of more than 1 mm (about 35% from the above grain distribution) and a small amount of fine material powders each less than 1 mm in diameter are discharged through the lower chute 36. It will be noted that the diameter of the material and the discharge amount thereof that flows through the upper chute 35 can be freely changed or controlled as occasion demands by regulating the valve 34*b* and the gate 36*a***.

As described above, in the grinding apparatus of FIG. 1, the conveyor tube 22 is connected to the material inlet port **33*a* of the classifying device 30 so that the pre-ground material from the roller mill 10 is fed into the classifying device 30 through the material conveying path 20 and the upper chute 35 of the classifying device 30 is connected to the conveyor tube 23 as a portion of the material conveying path 20, which is connected to the tube mill 40. Accordingly, only the fine material powders each having a desired diameter can be fed into the tube mill. Thus, the balls each having a reduced diameter can be utilized in the tube mill 40, thereby improving the grinding efficiency. In the described embodiment, when only the fine material powders each having a diameter less than 1 mm are fed into the tube mill 40**, the balls each having a diameter of less than several to 40 mm can be utilized in the tube mill, whereas, in prior art devices where the pre-ground material is fed directly into the tube mill, the balls each having a diameter of about 17 mm to 70 mm are required. Thus, the grinding efficiency can be greatly improved.

Furthermore, in the grinding apparatus of the present invention, as shown in FIG. 1, the lower chute 36 of the classifying device 30 is connected to the material circulation path 25 which is connected also to the roller mill 10 and the material not fed into the tube mill 40 is returned to the roller mill 10. However, the material to be returned to the roller mill 10 includes a certain degree of the fine material with high bulk specific density, thus reducing the percentage of void, which in turn reduces or suppresses the generation of the vibration caused between the table 11 and the rollers 12 when the material is again ground, thus improving the grinding efficiency in the roller mill 10. When such returned material is fed together with the cement clinker from the hopper 16, the bulk specific density becomes about 1.9 to 2.1, which is remarkably higher than that, about 1.6, in a case where only the cement clinker is fed, thus providing a remarkable vibration reducing effect.

As described above, according to the grinding apparatus of the present invention, the grinding efficiency can be remarkably improved both in the roller mill 10 and the tube mill 40, and accordingly, an excellent productivity of the material can be realized, which may reduce the requirement of energy such as electric power consumption. Such advantageous effects can be achieved by providing the fluidized-bed-type classifying device 30 having a compact structure.

It is to be understood that the present invention is not limited to the described embodiment and many other changes and modifications may be made without departing from the scopes of the appended claims.

What is claimed is:

1. A method of grinding material particles by utilizing a grinding apparatus provided with a roller mill, a tube mill and a fluidized-bed-type classifying device having an inner hollow structure with an air introduction chamber and an unpartitioned fluidized-bed chamber, the air introduction chamber being separated from the unpartitioned fluidized-bed chamber by a porous partition plate, the method comprising the steps of:

feeding material particles into the roller mill where the material particles are pre-ground;

feeding the pre-ground material particles into said unpartitioned fluidized-bed chamber of said fluidized-bed-type classifying device;

fluidizing and classifying the pre-ground material particles in the unpartitioned fluidized-bed chamber;

feeding a fluidized portion of the pre-ground material particles, which includes a fine material component, into the tube mill;

returning a remaining portion of the pre-ground material particles not fed to the tube mill, which includes coarse material and some amount of fine material, to the roller mill; and grinding again the remaining portion of the pre-ground material particles together with newly fed material particles in the roller mill.

2. The grinding method according to claim 1, wherein fluidizing of the pre-ground material particles is performed by forcibly introducing air into the fluidized-bed-type classifying device.

3. The grinding method according to claim 2, wherein an amount of the fluidized material fed into the tube mill is regulated by adjusting an amount of the air introduced into the fluidized-bed-type classifying device.

4. A grinding apparatus comprising:

a roller mill into which material particles are fed and in which the material particles are pre-ground;

a fluidized-bed-type classifying device connected to the roller mill through a first material conveying line and having an inner hollow structure in which the pre-ground material particles are fluidized and classified, the inner hollow structure including an air introduction chamber and an unpartitioned fluidized-bed chamber, the air introduction chamber being separated from the unpartitioned fluidized-bed chamber by a porous partition plate;

means for fluidizing the pre-ground material in the fluidized-bed chamber;

a tube mill connected to the fluidized-bed-type classifying device through a second material conveying line; and a circulation line connecting the fluidized-bed-type classifying device and the roller mill, wherein a fluidized portion of the pre-ground material, which includes a fine material component, is fed into a tube mill, a remaining portion of the pre-ground material, which includes coarse material and some amount of fine material, not fed to the tube mill is returned to the roller mill through the circulation line and the remaining portion of the pre-ground material is again crushed together with newly fed material particles in the roller mill.

5. The grinding apparatus according to claim 4, wherein the fluidized-bed-type classifying device is provided with a first chute means connected to the second material conveying line through which the fluidized portion of the pre-ground material flows out to the tube mill and a second chute means connected to the circulation line through which the remaining portion of the pre-ground material is returned to the roller mill.

6. The grinding apparatus according to claim 5, wherein the porous partition plate is arranged horizontally with an inclination toward the second chute means, said fluidized bed chamber communicating with the first material conveying line and said air introduction chamber being disposed below the first section and communicating with the material fluidizing means.

7. The grinding apparatus according to claim 6, wherein the second chute means has a lower surface positioned substantially flush with an end portion of the inclined porous partition plate and the first chute means is disposed above the second chute means.

8. The grinding apparatus according to claim 7, wherein the inclination of the porous partition plate has about 30° with respect to a horizontal plane.

9. The grinding apparatus according to claim 6, wherein said material fluidizing means is an air introducing means connected to the lower portion of the air introduction chamber through which air is forcibly introduced into the fluidized bed chamber through the air introduction chamber and the porous partition plate to fluidize the material in the fluidized bed chamber.

10. The grinding apparatus according to claim 9, wherein said air introducing means is provided with an air flow rate control means for controlling a flow rate of air introduced into the fluidized-bed-type classifying device.

11. The grinding apparatus according to claim 10, wherein said air flow rate control means comprises an air flow rate control valve.

12. The grinding apparatus according to claim 6, wherein said second chute means is provided with a means for adjusting an amount of the material discharged from the fluidized-bed-type classifying device through the second chute means.

13. The grinding apparatus according to claim 12, wherein said adjusting means comprises a flow control gate having an opening that is variably controlled.

* * * * *